US006466111B1

(12) United States Patent
Wulff

(10) Patent No.: US 6,466,111 B1
(45) Date of Patent: Oct. 15, 2002

(54) COUPLER FOR RESONANT CAVITY

(75) Inventor: Torsten R. Wulff, Medford, OR (US)

(73) Assignee: Kathrein Inc., Scala division, Medford, OR (US)

( * ) Notice: Subject to any disclaimer, the term of this patent is extended or adjusted under 35 U.S.C. 154(b) by 0 days.

(21) Appl. No.: 09/723,618

(22) Filed: Nov. 27, 2000

Related U.S. Application Data

(60) Provisional application No. 60/169,186, filed on Dec. 6, 1999.

(51) Int. Cl.[7] ..... H01P 7/04; H01P 5/00

(52) U.S. Cl. ..... 333/222; 333/223; 333/230

(58) Field of Search ..... 333/202, 206, 333/208, 219, 219.1, 222, 227, 229, 230, 234, 203, 223

(56) References Cited

U.S. PATENT DOCUMENTS

| | | | | | |
|---|---|---|---|---|---|
| 3,187,278 | A | | 6/1965 | Wheeler | 333/226 |
| 3,577,100 | A | * | 5/1971 | Askew et al. | 331/117 D |
| 4,551,694 | A | | 11/1985 | Biehl et al. | 333/24 C |
| 4,686,494 | A | | 8/1987 | Kaneko et al. | 333/137 |
| 5,119,034 | A | * | 6/1992 | Ishikawa et al. | 324/633 |
| 5,604,471 | A | | 2/1997 | Rattila et al. | 333/202 |
| 5,608,363 | A | * | 3/1997 | Cameron et al. | 333/202 |
| 5,625,330 | A | | 4/1997 | Wilson et al. | 333/230 |
| 5,708,404 | A | | 1/1998 | Kurisu et al. | 333/202 |
| 5,750,473 | A | * | 5/1998 | Shen | 505/210 |
| 5,841,330 | A | | 11/1998 | Wenzel et al. | 333/202 |
| 5,942,959 | A | | 8/1999 | Kubo et al. | 333/202 |
| 5,945,888 | A | * | 8/1999 | Weinert et al. | 333/17.1 |

* cited by examiner

*Primary Examiner*—Robert Pascal
*Assistant Examiner*—Stephen E. Jones
(74) *Attorney, Agent, or Firm*—Dorsey & Whitney LLP

(57) ABSTRACT

A coupler for coupling RF electromagnetic energy into or out of a resonant cavity of the type which includes a control post.

6 Claims, 2 Drawing Sheets

COUPLER FOR RESONANT CAVITY

RELATED APPLICATIONS

This application claims priority to Provisional Application Ser. No. 60/169,186 filed Dec. 6, 1999.

BRIEF DESCRIPTION OF THE INVENTION

This invention relates to a coupler for coupling electromagnetic energy into or out of resonant cavities (herein I/O coupler).

BACKGROUND OF THE INVENTION

An RF resonant cavity (or multiple interconnected cavities) can be used to create an RF filter. The filter may either pass an RF signal over a limited frequency range (a bandpass filter) or exclude an RF signal over a limited frequency range (a notch or bandstop filter), depending upon how the resonator is connected to the overall system. A perfect single cavity resonant cavity would operate at a single, specific RF frequency (the resonant frequency), however due to material and other considerations all resonant frequency devices operate over a frequency range which encompasses the resonant frequency.

Referring to FIG. 1, an RF resonant cavity is shown having a conductive post or inner conductor 11 within a conductive cavity or housing 12. In the illustrated example, the cavity is a tunable cavity of the type shown and described in co-pending application Ser. No. 60/169,189 filed Dec. 6, 1999 (FHTAH File No. P-68696). The housing 12 can be formed by machining or by casting aluminum or other metal. An alternative would be to mold the housing from plastic and provide the interior wall 14 With a conductive coating. The cavity illustrated is a tunable cavity whereby the post includes a central bore 16 adapted to receive an adjustment screw or bolt 17. An enlarged well 18 is adapted to receive a spring 19. The inner conductor or post may be integral to the housing or an added component as shown in FIG. 1. A bellows 21 has one end rigidly fixed to the top of the center conductor 11 and its other end rigidly fixed to a top 23. The top contains a threaded bore (not shown) which receives an adjustment screw 17 which passes through the central bore 16, spring 19 and bellows 21, whereby rotation of the bolt adjusts the distance between the upper surface of the top 23 of the center post and the top surface of the cavity 14, thereby controlling the frequency of operation.

The RF signal or energy is coupled into and out of the cavity by means of a coaxial line 28 or a waveguide (not shown) suitably attached to the cavity and which extends through a hole 29 in the cavity wall. The coaxial connector is shown with the outer conductor connected to the housing which forms the ground of the system. In this manner, the housing is at system ground potential. The input structure is connected to the center conductor of the coaxial cable and is terminated in one of several ways, depending upon the mechanism used to input the RF energy into the cavity.

If the mechanism for coupling energy into the cavity is by influencing the magnetic field, the center conductor 30 of the connector will be connected by means of a wire loop 31 to the side or bottom of the housing, FIG. 1. This is an inductive coupling mechanism. Currents through the inner conductor 11 are terminated on the grounded housing. The current in the wire 31 generates a magnetic field within the housing that serves to excite the resonant cavity. By adjusting the area enclosed by the wire loop 31 it is possible to adjust the coupling of the structure for optimum system operation.

FIG. 2, which bears like reference numerals, shows another method of coupling electromagnetic energy into the cavity. The coupling is an electric field coupling. The center conductor 30 of the coaxial connector is terminated in a disc 33 located near but spaced from the tip of the inner conductor 11. In this case the disc 33 acts as an antenna. Currents in the inner conductor 11 create an electromagnetic field that excites the resonant cavity. By adjusting the location and orientation of the disc 33 relative to the tip of the inner conductor 11 it is possible to adjust the coupling to obtain optimum system operation.

In devices that couple the RF energy into the cavity using wire loop 31, the wire must have a good physical and electrical connection to the housing or inner conductor. Typically this is accomplished by soldering the end of the wire to the housing. However, since the housing is made of conductive metal, it is a very good conductor of heat. Therefore it is necessary to use a soldering method that is capable of providing a large heat source, which is expensive and difficult to do in production.

In devices that excite the cavity by electric field excitation using a conductive disk attached to the center conductor of the connector, the input coupling is adjusted by changing the size of the disk and/or the distance of separation between the disk and the inner conductor. Practical devices of this type must have the conductive disk very close to the inner conductor. This limits the power handling capability of the device. The maximum voltage level permissible is proportional to the input power and inversely proportional to the distance of separation between the conductive disk and the inner conductor. Therefore a coupler with a disc which is located 3 mm, for example, from the inner conductor can sustain roughly one-half of the input power of a device in which the disc is located 6mm from the inner conductor.

OBJECTS AND SUMMARY OF THE INVENTION

It is an object of the present invention to provide a coupler for resonant cavities which can operate with high input power.

It is another object of the present invention to provide a coupler which is easily tunable.

The foregoing and other objects of the invention are achieved by a coupler which is in the form of a configurable loop which defines a surface which is substantially parallel to the axis of the center conductor of the resonant cavity to which it is coupled.

DESCRIPTION OF THE FIGURES

The foregoing and other objects of the invention will be more clearly understood from the following description when read in conjunction with the accompanying drawings of which.

DESCRIPTION OF THE INVENTION

Figure 1:
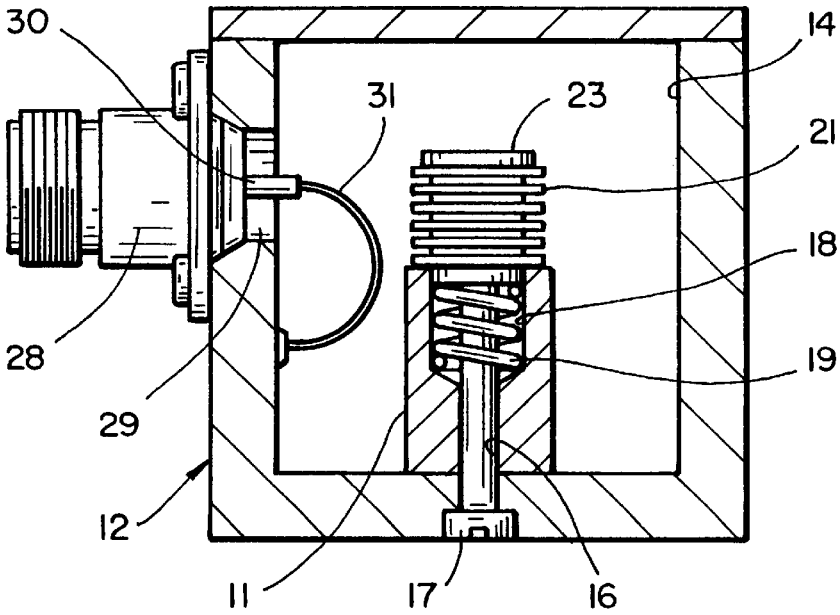
FIG 1 (PRIOR ART)
FIG. 1 shows a prior art resonant cavity with a conventional loop-type coupler.
Figure 2:
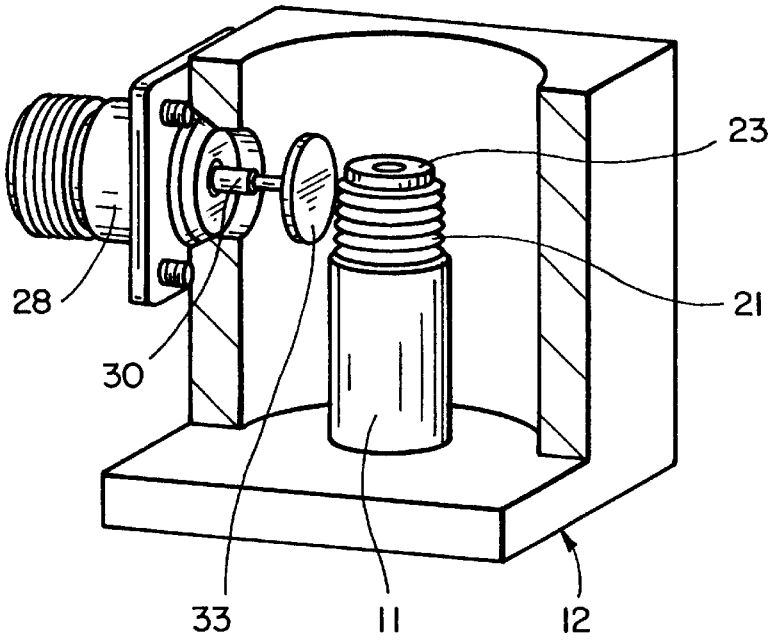
FIG 2 (PRIOR ART)
FIG. 2 shows a prior art resonant cavity with a conventional disk-type coupler.
Figure 3:
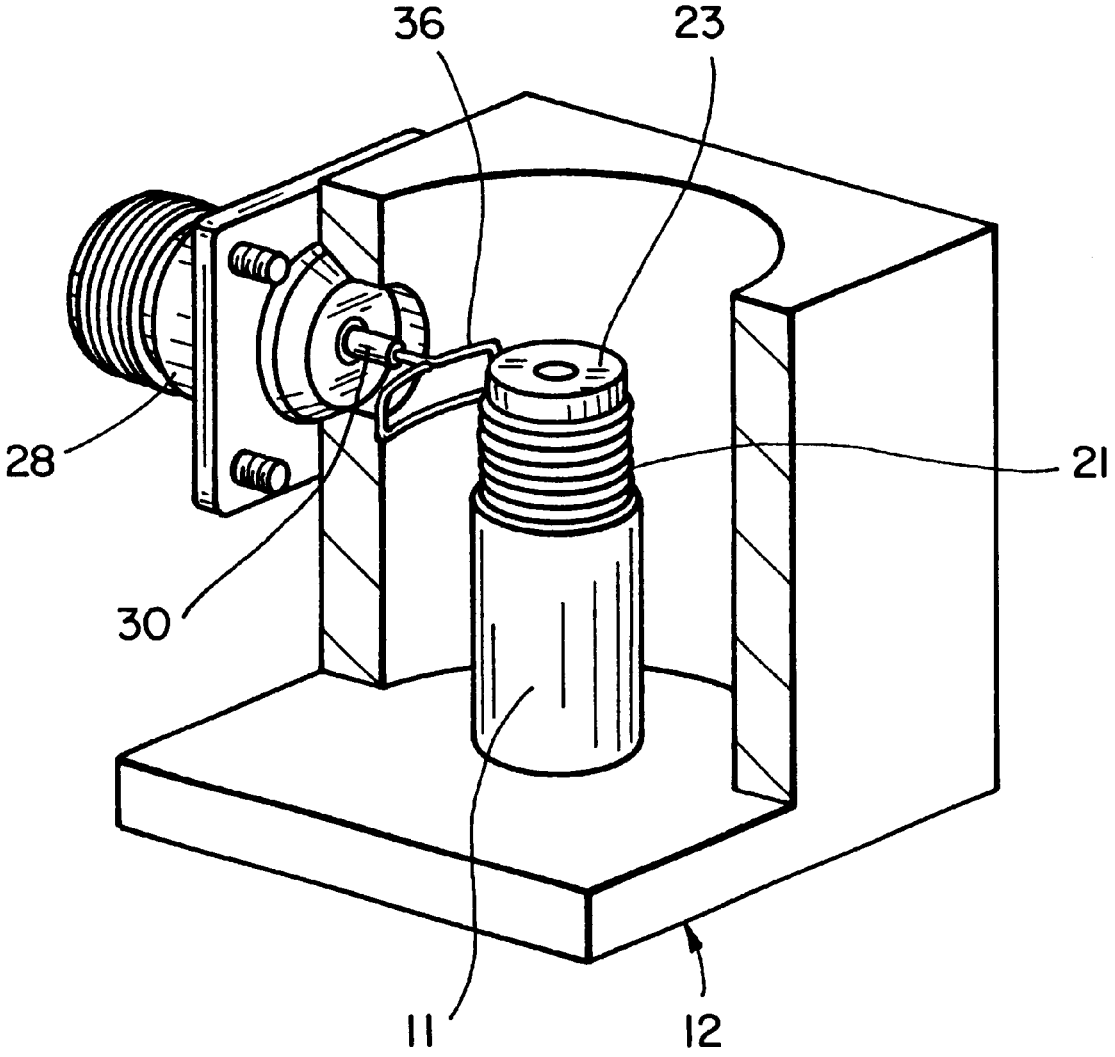
FIG. 3 illustrates a resonant cavity with a loop-type coupler in accordance with the present invention.

Referring now particularly to FIG. 3, where like reference numerals have been applied to like parts, the center conductor 30 of the coaxial connector 28 is connected to a conductive loop 36 of rectangular configuration and defines a curved surface which is parallel to the axis of the inner conductor 11. Although a curved rectangular loop 36 has been illustrated, it is apparent that the loop 36 can have other configurations such as elliptical, round, oblong, etc., which can define a curved or planar surface. The loop 36 is spaced away from the inner conductor 11 and is coupled to the inner conductor by electric fields. The loop 36 is analogous to an antenna. The benefit of the loop structure is that it can be located much further away from the inner conductor 11 than a conductive disk, such as shown in FIG. 2, for equivalent coupling to the cavity. This results in a structure that has greater immunity to high-voltage levels and is able to handle greater input power. In addition, adjustment of the amount of coupling is quite simple. One merely bends the wire loop 36 to tune the coupling to the desired value. In production, this is a much more efficient method of tuning a resonant cavity coupler.

The foregoing descriptions of specific embodiments of the present invention are presented for the purposes of illustration and description. They are not intended to be exhaustive or to limit the invention to the precise forms disclosed; obviously many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents.

What is claimed is:

1. A coupler for use in resonant cavities of the type which include a conductive housing having top, bottom and side walls and an inner conductor having a base attached to the bottom and a free end extending towards and spaced from the top of the housing comprising:

a coaxial line having a center conductor extending into said housing, a conductive loop having its ends connected to the center conductor, said loop defining a surface which is substantially parallel to the axis of the inner conductor and spaced from the inner conductor, said loop being configurable to control the electrical coupling between the loop and the inner conductor, said loop being positioned substantially proximate the free end of the inner conductor.

2. A coupler as in claim 1 in which the loop is rectangular.

3. A coupler as in claim 1 in which the defined surface is curved.

4. A coupler as in claim 1 in which the loop is circular.

5. A coupler as in claim 1 in which the loop is oblong.

6. A coupler as in claim 1 in which the loop is elliptical.

* * * * *